US005899631A

United States Patent [19]

Jaszkowiak

[11] Patent Number: 5,899,631

[45] Date of Patent: May 4, 1999

[54] ASSISTED STEERING LINKAGE FOR A RIDING POWER TROWEL

[75] Inventor: Timothy S. Jaszkowiak, Boise, Id.

[73] Assignee: Whiteman Industries, Inc., Boise, Id.

[21] Appl. No.: 09/045,413

[22] Filed: Mar. 19, 1998

[51] Int. Cl.[6] ..... E01C 19/22; F16H 21/44

[52] U.S. Cl. ..... 404/112; 74/97.1; 74/100.1

[58] Field of Search ..... 404/112; 74/97.1, 74/100.1

[56] References Cited

U.S. PATENT DOCUMENTS

| | | | |
|---|---|---|---|
| 2,402,932 | 6/1946 | Van Buskirk | 74/97.1 |
| 3,936,212 | 2/1976 | Holz, Sr. et al. | 404/112 |
| 4,046,484 | 9/1977 | Holz, Sr. et al. | 404/112 |
| 4,223,611 | 9/1980 | Dawson et al. | 104/247 |
| 4,710,055 | 12/1987 | Maass et al. | 404/112 |
| 4,775,306 | 10/1988 | Kikuchi et al. | 425/62 |
| 4,848,960 | 7/1989 | Kajioka et al. | 404/112 |
| 4,859,114 | 8/1989 | Artzberger | 404/112 |
| 5,108,220 | 4/1992 | Allen et al. | 404/112 |
| 5,146,800 | 9/1992 | Farrell | 74/100.1 |
| 5,238,323 | 8/1993 | Allen et al. | 404/85 |
| 5,401,096 | 3/1995 | Stang | 312/319.2 |
| 5,480,258 | 1/1996 | Allen | 404/112 |
| 5,613,801 | 3/1997 | Allen | 404/112 |
| 5,685,667 | 11/1997 | Allen | 404/112 |
| 5,816,739 | 10/1998 | Allen | 404/112 |
| 5,816,740 | 10/1998 | Jaszkowiak | 404/112 |

*Primary Examiner*—Thomas B. Will
*Assistant Examiner*—Gary S. Hartmann
*Attorney, Agent, or Firm*—Frank J. Dykas; Robert L. Shaver

[57] ABSTRACT

A torque applying device for use with a steering mechanism for a riding power trowel, wherein the torque applying device is pivotally attached to a steering lever at the first end, and to the frame of the power trowel at a second end and in longitudinal alignment with the steering lever when the steering lever is in its at-rest position, and capable of arcuate rotation about its second end from a position where its longitudinal axis is in alignment with the steering lever to a position for imparting a torque force to the lever to assist rotation of the lever when the lever is rotated from its at-rest position for purposes of tilting a power trowel gear box.

22 Claims, 6 Drawing Sheets

ASSISTED STEERING LINKAGE FOR A RIDING POWER TROWEL

BACKGROUND OF THE INVENTION

1. Technical Field

This invention generally relates to improved steering linkage for riding power trowels, and more particularly to devices for applying a torque force to a steering linkage lever or a tilting gear box.

2. Background

Riding power trowels have been known in the prior art for many years. The principals upon which they rely to provide directional control are also well known and set forth with particular clarity in the Holtz, U.S. Pat. No. 4,046,484, the teachings of which are herein incorporated by reference.

Basically stated, riding power trowels require at least two tiltable gear boxes which are operatively connected to a plurality of troweling paddles arranged in a radial array to form tiltable troweling assemblies. These tiltable troweling assemblies are counter-rotated, and when they are both tilted inwardly or outwardly, depending upon the direction of the counter rotation, the power trowel will move either forward or backward across the concrete surface being troweled. When they are tilted in the opposite direction, the riding power trowel will move in the opposite direction.

Also typical in the prior art at least one of the tiltable power trowel assemblies is tiltable forward and backwards, and depending upon the direction of rotation, if the trowel assembly is tilted forward, it will impart a sideways motion to the trowel in one direction, and if the trowel assembly is tilted backward, it will impart a motion in the opposite direction.

All of this is well known and fully explained in Holtz, U.S. Pat. No. 4,046,484.

In the prior art, the operator typically is seated atop of the power trowel and has available to him two steering handles, to which steering linkage is attached, in various configurations, for the ultimate purpose of providing mechanical force to tilt the gear boxes of the trowel assemblies. There are numerous varied configurations of steering linkage with most configured to provide some intuitive control for the operator, such as pushing the steering handles forward moves the power trowel in a forward direction, pulling back on the steering handles moves the trowel in a rearward direction, and tilting at least one steering handle tiltable to either the left or right to move the power trowel in the selected direction. A typical configuration for steering linkage is described in detail in the Best Mode section of this specification.

Whatever the configuration of the steering linkage, there must be at least one lever interconnecting the steering handles and the tiltable gear boxes for purposes of tilting them. This lever must pivot about one fixed point connected to the frame of the power trowel.

The problem is that riding power trowels are heavy, with most weighing between 500 lbs. to 1200 lbs. As a result, many attempts have been made to improve the mechanical advantage available to the operator through the steering handles, to assist the operator in tilting the gear boxes and the attached trowel assemblies from a flat at-rest position to a tilted position to control steering. One such example is found in the Allen, U.S. Pat. No. 5,108,220, wherein the tilting levers are attached at a pivot point at the rear of the machine, and extend substantially most of the way toward the front of the machine to provide a greater mechanical advantage to the operator. However, such extended leverage increases the weight of the machine, and the cost of fabrication of the riding power trowel. Also, the mechanical advantage gained from such devices is limited, and the operator is still required to apply considerable force to the steering handles in order to maintain control of the machine. Over several hours of operation, the operator can become fatigued and thus pose a threat to the safety of himself and others.

Accordingly, what is needed is a simple, lightweight assisted steering device which is capable of exerting considerable force to provide the mechanical advantage to the operator and thus to reduce the amount of force required to be expended by the operator to move the steering handles and thereby tilt the gear boxes of the trowel assemblies.

DISCLOSURE OF INVENTION

These objects are achieved by use of a torque applying device which is pivotally attached to a steering lever which itself is rotatable about a pivot point from an at-rest position in which the tiltable gear box and its attached radial array of troweling paddles are flat to the surface of the concrete, and the torque applying device is in longitudinal alignment with said lever, and therefore not applying any torque forces. As the steering lever is pivoted about its pivot point to tilt the gear box, the torque applying device, which is pivotally attached as previously stated to the lever at one end, and pivotally attached to an anchor point on the frame at a second end, applies torque which is capable of assisting in the arcuate rotation of the steering lever about its pivot point. The torque applying device can be either a compression device, such as a spring loaded cylinder, or a tensioning device such as a spring, as long as it is pivotally mounted or anchored to the frame at one end and attached to the steering assembly or the tiltable gear box at a second end, and capable of arcuate rotation about its first end from a position where no torque force is applied to the steering assembly to a position wherein a torque force is applied to the steering assembly when the steering lever is pivoted to tilt the gear box.

BEST MODE FOR CARRYING OUT INVENTION

Figure 1:
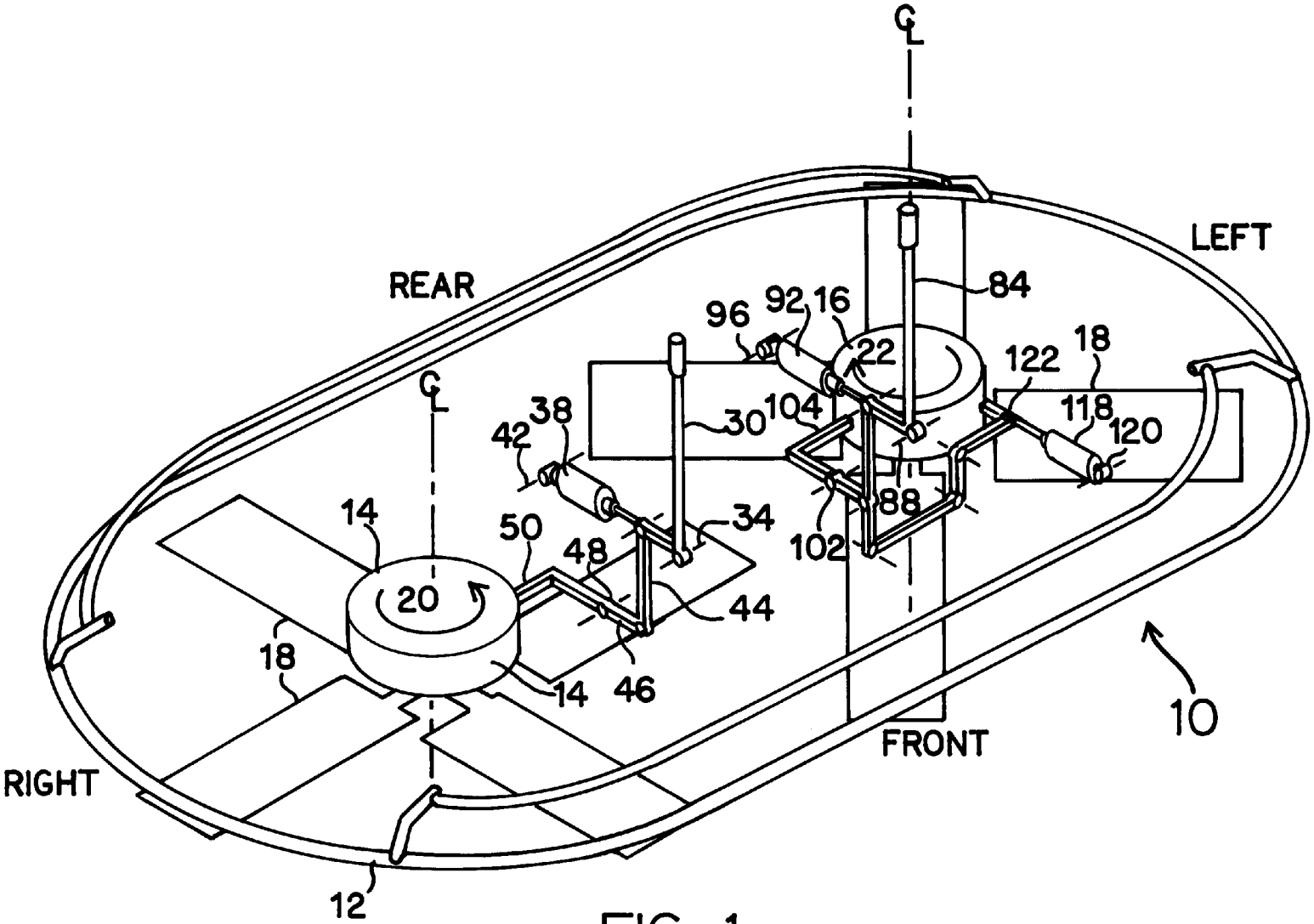
FIG. 1 is a partial sectional view of a riding power trowel showing the steering mechanism.
Figure 2:
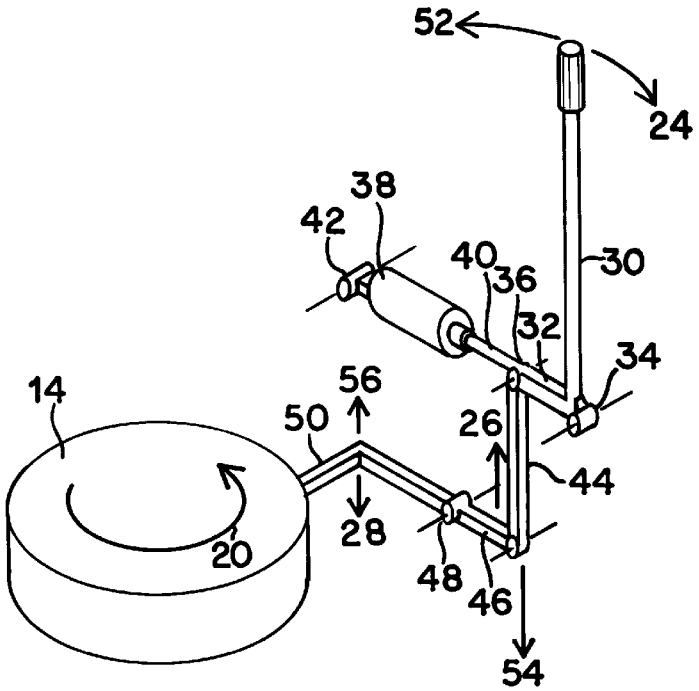
FIG. 2 is a perspective representational view of the forward and reverse steering mechanism using a compression device for assisting steering.

Referring first to FIG. 1, there is shown the lower half of a typical riding power trowel 10. Shown therein are two tiltable gear boxes, right gear box 14 and left gear box 16. Each is attached to a radial array of trowel paddles 18 and are tiltable about their center lines for achieving directional control of the power trowel. The right trowel assembly of tiltable gear box 14 rotates in the direction of arrow 20. Tiltable left gear box 16 counter rotates in the direction of arrow 22. When both gear boxes 14 and 16 are tilted inward, this riding power trowel will move in a forward direction. When both are tilted outward, it will move in a rearwardly direction. In this Best Mode description, the steering linkage for tiltable gear box 14, only provides control in the inward and outward directions to achieve forward and reverse movement while the steering linkage for the tiltable left gear box 16 provides tiltable control not only in the inward and outward directions, but also forward and backwards so as to provide movement of the power trowel in both the left and right directions. While this specification describes only one four-way tiltable control steering linkage assembly, it should be apparent to those skilled in the art that two could be provided, as opposed to just one. The steering linkage for right gear box 14 is shown in greater detail in FIG. 2.

Figure 3:
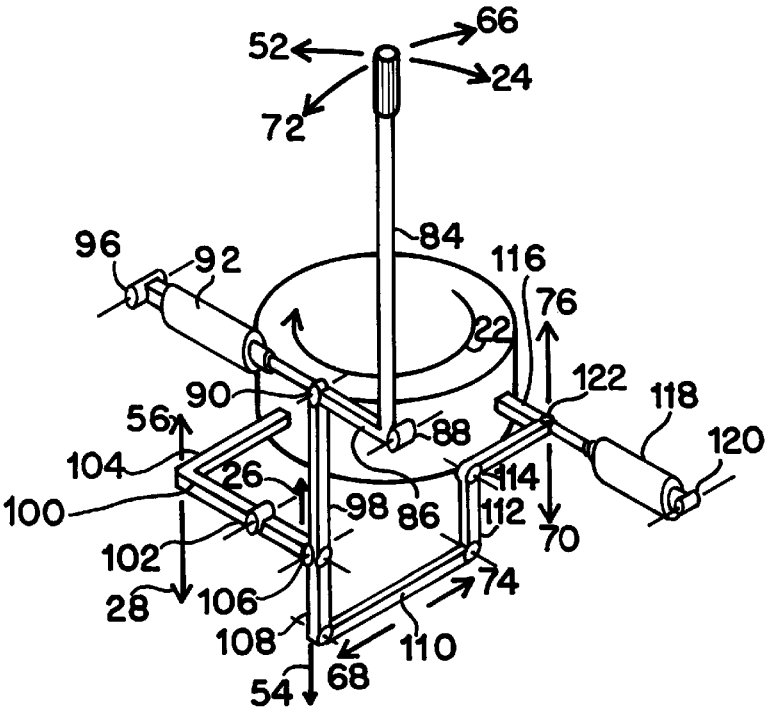
FIG. 3 is a perspective representational view of a combination forward, reverse and sideways steering mechanism using compression devices for assisting steering.

Right steering handle 30 is rigidly connected to steering lever 32 and pivotal about pivot point 34. Connected to steering lever 32 at pivot point 36 is steering linkage rod 44, which itself is pivotally connected to gear box lever 46. Gear box lever 46 pivots about gear box lever pivot point 48. At the opposite end of gear box lever 46 is attached connecting rod 50 which connects directly to tiltable right gear box 14. As steering handle 30 is pushed forward in the direction of arrow 24, steering lever 32 and attached linkage rod 44 rotate in the direction of arrow 26. As this occurs, gear box lever 46 rotates in the direction of arrow 28 and thus tilts right gear box 14 inwardly to impart a forward motion to the riding power trowel. When steering handle 30 is pulled in the direction of arrow 52, steering lever 32 and attached linkage rod 44 rotate in the direction of arrow 54. As this occurs, gear box lever 46 rotates in the direction of arrow 56 and thus tilts right gear box 14 outwardly to impart a reverse motion to the riding power trowel. As shown in FIG. 3, left steering handle 84 is rigidly connected to steering lever 86 and pivotal about pivot point 88. Connected to steering lever 86 at pivot point 90 is steering linkage rod 98, which itself is pivotally connected to gear box lever 100. Gear box lever 100 pivots about gear box lever pivot point 102. At the opposite end of gear box lever 100 is attached connecting rod 104 which connects directly to tiltable left gear box 16. As steering handle 84 is pushed forward in the direction of arrow 24, steering lever 86 and attached linkage rod 98 rotate in the direction of arrow 26. As this occurs, gear box lever 100 rotates in the direction of arrow 28 and thus tilts left gear box 16 inwardly to impart a forward motion to the riding power trowel. When steering handle 84 is pulled in the direction of arrow 52, steering lever 86 and attached linkage rod 98 rotate in the direction of arrow 54. As this occurs, gear box lever 100 rotates in the direction of arrow 56 and thus tilts left gear box 16 outwardly to impart a reverse motion to the riding power trowel.

As previously stated, steering linkage assembly for left gear box 16 is also capable of tilting left gear box 16 in forward and aft directions. This is accomplished by the addition of linkage rod extension 108 and the addition of four way pivot point 106 to enable linkage rod extension 108 to rotate in the direction of arrow 68 when steering handle 84 is pushed in the direction of arrow 66, and in the direction of arrow 74, when handle 84 is pushed in the direction of arrow 72. Linkage rod extension 108 interconnects to forward tilt control linkage rod 110, which is pivotally attached to forward tilt control lever 112, which pivots about pivot point 114. As steering handle 84 is pushed in the direction of arrow 66, linkage rod extension 108 moves in the direction of arrow 68 and forward tilt control lever 112 moves in the direction of arrow 70, thus tilting down left gear box 16 in a forward direction, and the riding power trowel will crab to the left.

If steering handle 84 is tilted in the direction of arrow 72, the opposite will occur, with linkage rod extension 108 moving in the direction of arrow 74, and forward tilt control lever 112 moving in the direction of arrow 76, thus moving connecting rod 116 upwardly and tilting left gear box 16 rearwardly to cause the riding power trowel to crab to the right.

All of this is fairly typical and representative of the current state of the art. What is new, is the addition of compression or tensioning devices which provide an additional mechanical advantage to the operator and reduce the amount of force required to be exerted by the operator in moving either or both steering handles 30 and 84.

Referring to FIGS. 2 and 4A, 4B and 4C, there is shown the addition of a torque applying device, namely compression cylinder 38, which is pivotally attached to the trowel frame 12 at pivot point 42 and pivotally attached to the steering lever 32 at pivot point 36.

Figure 4A:
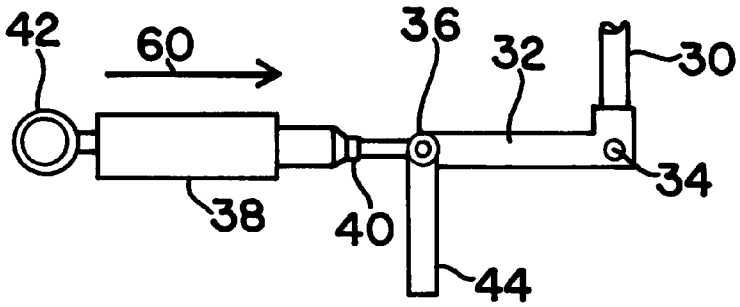
FIG. 4A is a representational view of the new compression device in longitudinal alignment with a steering lever.

The compression device in the preferred embodiment is merely a spring loaded cylinder capable of remaining in maximum compression when its longitudinal axis is aligned with steering lever 32, as shown in FIG. 4A, and provides compressive force between pivot point 42 for compression cylinder 38 and pivot point 34 for steering lever 32. There are numerous other types of compression devices, including gas charged cylinders, hydraulic cylinders and other types of pneumatic devices, the only requirement being that the compression device be capable of remaining in compression when no-tilting forces are being exerted against a gear box by a steering lever, and be capable of extension to impart a torque force to a steering lever to assist in rotation of the steering lever. This alignment is maintained as long as the power trowel is at an "at-rest position" with no tilting forces being exerted. The amount of compression is intentionally designed to be insufficient to overcome the weight of the machine, thus maintaining the alignment and compression as long as the device is in its "at-rest" position with no force being exerted by the operator on steering handles 30 or 84.

Figure 4B:
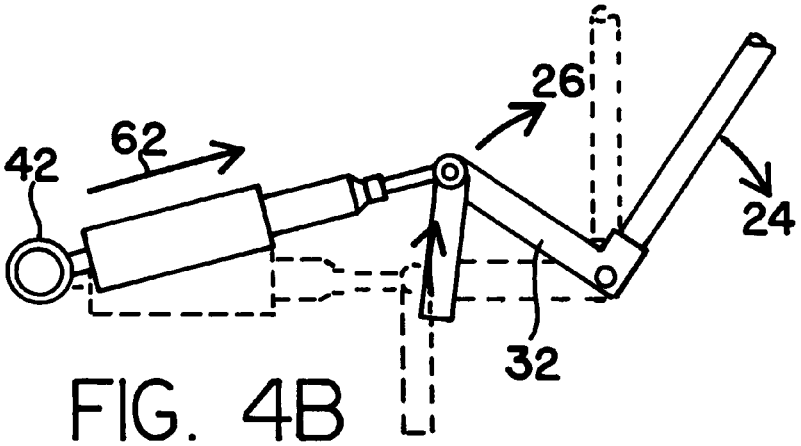
FIG. 4B is a representational side view of the compression device applying a torque force to the steering lever in a first direction.

When the operator pushes forward on steering handle 30 in the direction of arrow 24, then as shown in FIG. 4B, steering lever 32 rotates upward, and as it does so, compression cylinder 38 is able to exert a torque force in the direction of arrow 62 to assist in the rotation of steering lever 32 in the direction of arrow 26.

The amount of compression or torque force can be preselected to achieve a desired reduction of the mechanical force required to be imparted to the steering handle by the operator. If for example, the basic mechanical advantage of the steering linkage would require the exertion of 80 pounds of torque force by the operator against handle 30, and it is desired to reduce that by seventy-five (75%) per cent, then the compression device 38 could be engineered to produce a torque force at pivot point 36 which would be equivalent to 60 pounds of torque force being applied by the operator to steering handle 30.

Figure 4C:
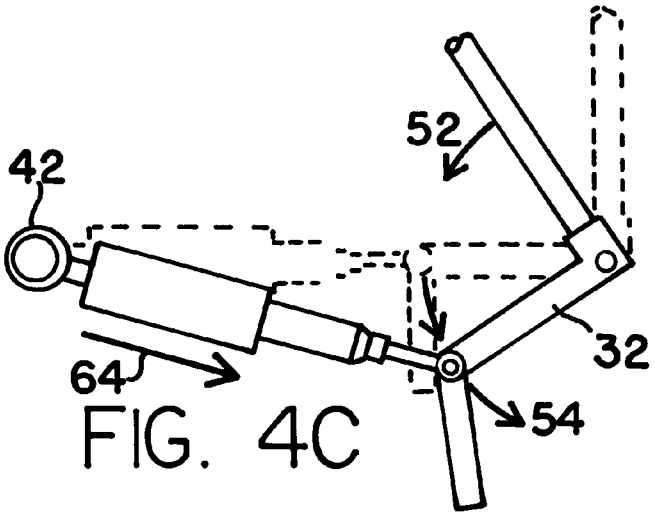
FIG. 4C is a representational side view of the compression device applying a torque force to the steering lever in a second direction.

Also, as shown in FIG. 4C, when the operator pulls back on steering handle 30 in the direction of arrow 52, steering lever 32 moves in the direction of arrow 54, and compression device 38 imparts a torque force in the direction of arrow 64.

In a like manner, as shown in FIG. 3, compression device 92 interconnects at pivot point 90 to steering lever 86, and is held in alignment when steering handle 84 is in the at-rest position between pivot point 96 and pivot point 88. Steering assistance is in the forward and aft tilting of left gear box 16 is provided by compression device 118, which is pivotally attached to the frame at pivot point 120 and to forward tilt control lever 112 at steering assist pivot point 122. All three compression devices provide steering assistance in the same manner as shown in FIGS. 4A, 4B and 4C.

Figure 5:
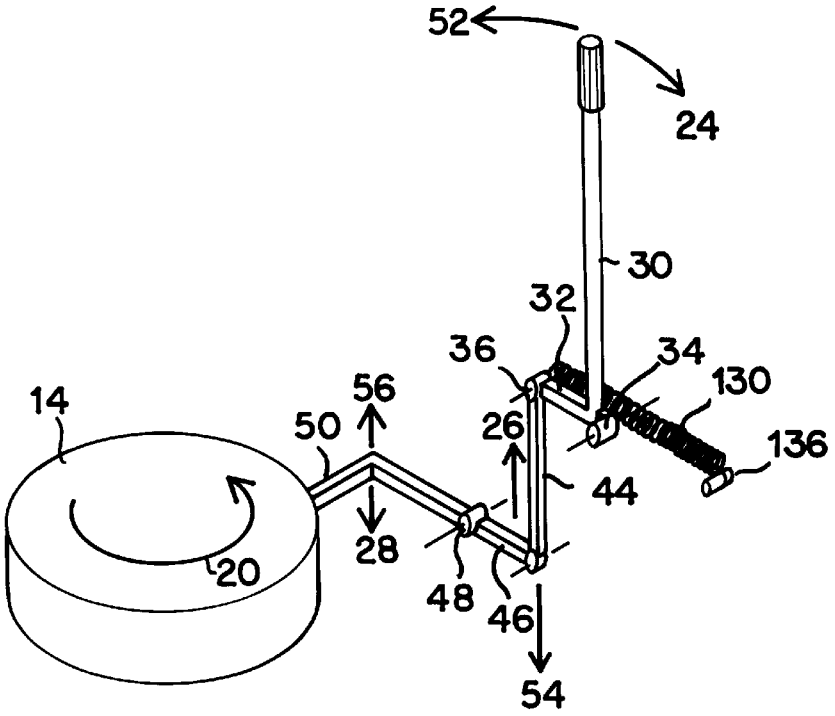
FIG. 5 is a perspective representational view of the forward and reverse steering mechanism using a tensioning device for assisting steering.

As an alternative to a compression device, a tensioning device can also be used as the torque applying device to apply the torque force. FIGS. 5, 6, 7A, 7B and 7C show essentially the same representative steering mechanism as FIGS. 2, 3, 4A, 4B and 4C, except that instead of a compression device, a tensioning device is used. In this second embodiment of the preferred embodiment, the tensioning devices are simply coiled springs 130, 132 and 134. However, as with the compression devices, they could be spring loaded, or hydraulic or pneumatic cylinders. In FIGS. 5, 7A, 7B and 7C there is shown coiled spring 130 used as a tensioning device and interconnected to steering lever 32 at pivot point 36 and to the frame at connection point 136 in a position where it is in alignment with the longitudinal axis of steering lever 32 when no tilting forces are being applied through handle 30, as is shown in FIGS. 5 and 7A.

Figure 7A:
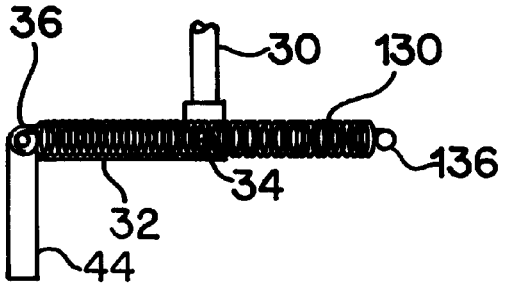
FIG. 7A is a representational view of the tensioning device in longitudinal alignment with a steering lever.
Figure 7B:
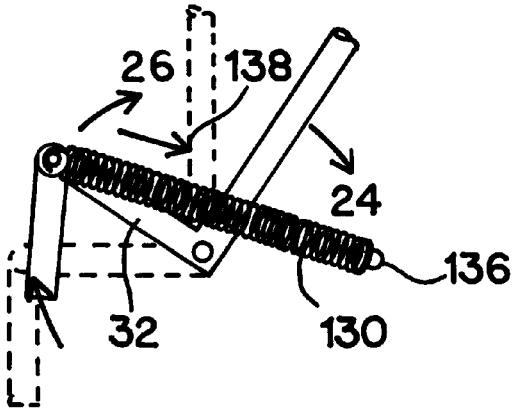
FIG. 7B is a representational side view of the tensioning device applying a torque force to the steering lever in a first direction.
Figure 7C:
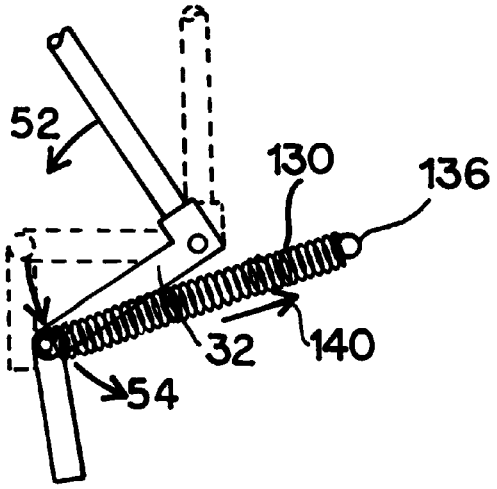
FIG. 7C is a representational side view of the tensioning device applying a torque force to the steering lever in a second direction.

When the operator pushes forward on steering handle 30 in the direction of arrow 24, then as shown in FIG. 7B, steering lever 32 rotates upward, and as it does so, tensioning device 130 is able to exert a torque force in the direction of arrow 138 to assist in the rotation of steering lever 32 in the direction of arrow 26. Also, as shown in FIG. 7C, when the operator pulls back on steering handle 30 in the direction of arrow 52, steering lever 32 moves in the direction of arrow 54, and tensioning device 130 imparts a torque force in the direction of arrow 140.

Figure 6:
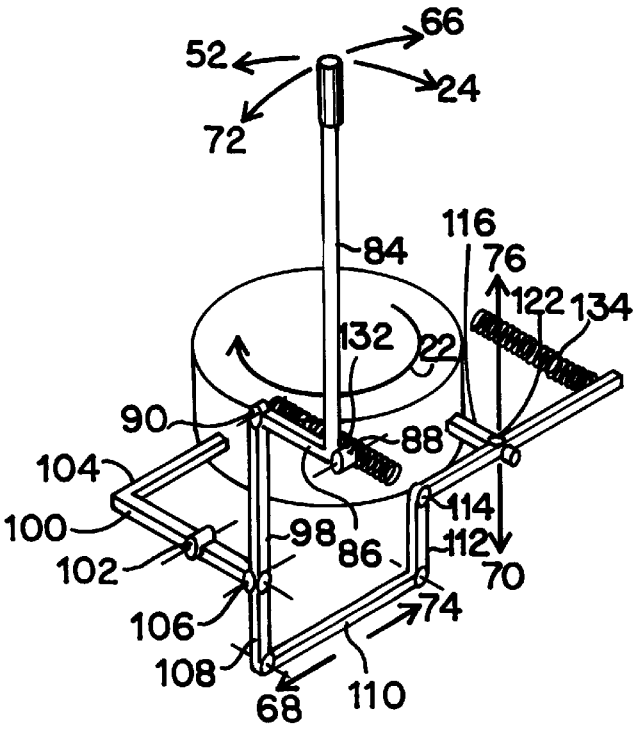
FIG. 6 is a perspective representational view of the combination forward, reverse and sideways steering mechanism using tensioning devices for assisting steering.

In a like manner, as shown in FIG. 6, tensioning devices 132 and 134 are capable of applying torque forces against the steering levers to assist in steering by reducing the amount of force required of the operator when manipulating steering handle 84.

While this section of the specification discloses the use of compression devices 38, 92 and 118 and tensioning device: 130, 132 and 134, in specific locations, it should be pointed out and distinctly understood that there are alternative places where they can be located. All that is required is that they be pivotally attached to a steering lever at one end. For example, compression cylinder 38 could also be attached to either end of gear box lever 46. Compression cylinder 92 could be attached to either end of gear box lever 100, and compression cylinder 118 could be attached to either end of linkage rod 110. In a like manner, the tensioning devices shown and disclosed in FIGS. 5 and 6, can be reconfigured to be attached to the same locations as the compression cylinders are.

Figure 8:
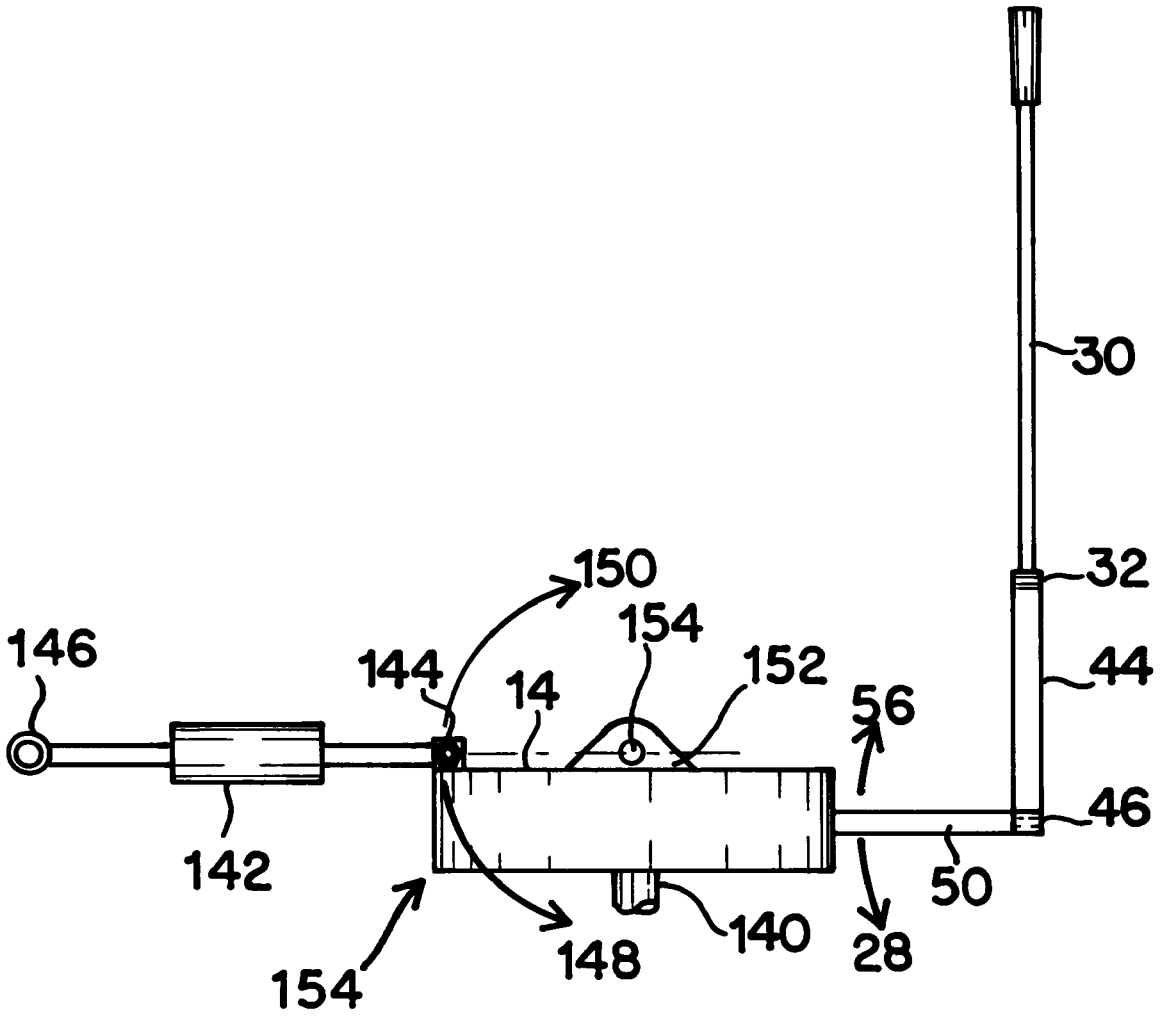
FIG. 8 is a representational front view of the forward and reverse steering mechanism of FIG. 2, using a compression device attached to the gear box for assisting steering.

The gear box itself can also function as the lever, since it has a solid stationary outer housing, and a pivot point. There is shown in FIG. 8 a front representational view of the forward and reverse steering mechanism of FIG. 2, with some additional structure added. Gear box 14 is shown, together with its support bracket 152 and support pivot point 154, which is the pivot point about which right gear box 14 rotates. Also shown is output shaft 140, which is connected to the radial array of paddles, not shown in FIG. 8.

Also, as shown in FIG. 8, attached to left gear box 14 is compression device 142. Compression device 142 is attached to left gear box 14 at pivot point 144, which is in alignment with pivot point 154 of left gear box 14. The opposite end of compression device 142 is attached at pivot point 146 to the frame assembly. In this configuration, when handle 30 is pushed forward, connecting rod 50 will move downwardly in the direction of arrow 28, and the opposite end of left gear box 14 will move upwardly in the direction of arrow 150, being assisted by compression device 142 applying a torque force. If handle 30 is pulled backward, connecting rod 50 will move upward in the direction of arrow 56 and the opposite end of left gear box 14 will move downwardly in the direction of arrow 148, also being assisted by a torque force applied by compression device 142. In a similar manner, a tensioning device could be used as opposed to the compression device 142, and, either a compression or tensioning device could also be used to apply a torque force to help rotate right gear box 16 in both the forward and rearward directions.

In all cases, it is best if the longitudinal axis of the torque applying device is aligned coincident with the axis defined between the lever or tiltable gear box pivot point and the attachment point on the lever or tiltable gear box. However, it does not actually be coincident. It can be parallel. Indeed with tensioning devices used as torque applying devices, it usually must be parallel as is shown in FIGS. 5 and 6. If the axis of both the lever or tiltable gear box and the torque applying device are located parallel to each other, then it is best that they are parallel within a plane normal to the plane defined by the arc of rotation of the lever or tiltable gear box. But even that is not essential. For example, as shown in FIG. 8, if compression device 142 were to be down to attach at point 154, with its axis again aligned parallel to the axis defined by pivot point 154 and attachment point 144, it would still work to apply torque forces, except that it would not work as well when right gear box 14 is rotated in the direction of arrow 150 since the arc of rotation, as shown in arrow 150, would cause compression device 142 to compress slightly before it begins to extend and thusly apply an assisting torque force.

It is the interconnection of a torque applying device to any steering lever or the gear box, rotatable about a pivot point from an "at rest" position to a tilted position to tilt a gear box that is required.

While there is shown and described the present preferred embodiment of the invention, it is to be distinctly understood that this invention is not limited thereto but may be variously embodied to practice within the scope of the following claims.

I claim:

1. In a riding power trowel having a frame and a tiltable gear box, said tiltable gear box further operably interconnected to a lever having an attachment point and a pivot point and a longitudinal axis extending between said attachment point and said pivot point, and said lever being rotatable about said pivot point from an at-rest position to selectively apply a tilting force to said tiltable gear box, an assisted steering linkage which comprises:

a torque applying device having first and second ends and a longitudinal axis extending between said first and second ends, pivotally attached at its first end to said lever attachment point, and pivotally attached at its second end to said frame in a position wherein said longitudinal axis of said torque applying device is parallel with the longitudinal axis of said lever when said lever is in its at-rest position, said torque applying device further being capable of arcuate rotation about its second end and operable to impart a force to said lever at its attachment point to assist rotation of said lever when said lever is rotated from its at-rest position for purposes of tilting said gear box.

2. The assisted steering linkage of claim 1 wherein said torque applying device further comprises:

a compression device having first and second ends and a longitudinal axis extending between said first and second ends, pivotally attached at its first end to said lever attachment point, and pivotally attached at its second end to said frame in a position wherein said longitudinal axis of said torque compression device is parallel to the longitudinal axis of said lever when said lever is in its at-rest position, said compression device further being capable of arcuate rotation about its second end and extendible under compression to impart a force to said lever at its attachment point to assist rotation of said lever when said lever is rotated from its at-rest position for purposes of tilting said gear box.

3. The assisted steering assembly of claim 2 wherein said compression device further comprises a spring loaded cylinder.

4. The assisted steering assembly of claim 2 wherein said compression device further comprises a pneumatic cylinder.

5. The assisted steering assembly of claim 2 wherein said compression device further comprises a hydraulic cylinder.

6. The assisted steering assembly of claim 2 wherein said compression device further comprises a spring.

7. The assisted steering linkage of claim 1 wherein said torque applying device further comprises:

a tensioning device having first and second ends and a longitudinal axis extending between said first and second ends, pivotally attached at its first end to said lever attachment point, and pivotally attached at its second end to said frame in a position wherein said longitudinal axis of said tensioning device is parallel to the longitudinal axis of said lever when said lever is in its at-rest position, said tensioning device further being capable of arcuate rotation about its second end and retractable under tension to impart a force to said lever at its attachment point to assist rotation of said lever when said lever is rotated from its at-rest position for purposes of tilting said gear box.

8. The assisted steering assembly of claim 7 wherein said tensioning device further comprises a spring loaded cylinder.

9. The assisted steering assembly of claim 7 wherein said tensioning device further comprises a pneumatic cylinder.

10. The assisted steering assembly of claim 7 wherein said tensioning device further comprises a hydraulic cylinder.

11. The assisted steering assembly of claim 7 wherein said tensioning device further comprises a spring.

12. In a riding power trowel having a frame and a tiltable gear box having an attachment point and a pivot point and a longitudinal axis extending between said attachment point and said pivot point, said tiltable gear box further being tiltable about said pivot point from an at-rest position to selectively apply a motive force to said riding power trowel, an assisted steering linkage which comprises:

a torque applying device having first and second ends and a longitudinal axis extending between said first and second ends, pivotally attached at its first end to said tiltable gear box attachment point and pivotally attached at its second end to said frame in a position wherein said longitudinal axis of said torque applying device is parallel to the longitudinal axis of said tiltable gear box when said tiltable gear box is in its at-rest position, said torque applying device further being capable of arcuate rotation about its second end and operable to impart a torque force to said tiltable gear box at its attachment point to assist rotation of said tiltable gear box when it is rotated from its at-rest position.

13. The assisted steering linkage of claim 12 wherein said torque applying device further comprises:

a compression device having first and second ends and a longitudinal axis extending between said first and second ends, pivotally attached at its first end to said tiltable gear box attachment point and pivotally attached at its second end to said frame in a position wherein said longitudinal axis of said compression device is parallel to the longitudinal axis of said tiltable gear box when said tiltable gear box is in its at-rest position, said compression device further being capable of arcuate rotation about its second end and operable to impart a torque force to said tiltable gear box at its attachment point to assist rotation of said tiltable gear box when it is rotated from its at-rest position.

14. The assisted steering assembly of claim 13 wherein said compression device further comprises a spring loaded cylinder.

15. The assisted steering assembly of claim 13 wherein said compression device further comprises a pneumatic cylinder.

16. The assisted steering assembly of claim 13 wherein said compression device further comprises a hydraulic cylinder.

17. The assisted steering assembly of claim 13 wherein said compression device further comprises a spring.

18. The assisted steering linkage of claim 12 wherein said torque applying device further comprises:

a tension device having first and second ends and a longitudinal axis extending between said first and second ends, pivotally attached at its first end to said tiltable gear box attachment point and pivotally attached at its second end to said frame in a position wherein said longitudinal axis of said tension device is parallel to the longitudinal axis of said tiltable gear box when said tiltable gear box is in its at-rest position, said tension device further being capable of arcuate rotation about its second end and operable to impart a torque force to said tiltable gear box at its attachment point to assist rotation of said tiltable gear box when it is rotated from its at-rest position.

19. The assisted steering assembly of claim 18 wherein said tensioning device further comprises a spring loaded cylinder.

20. The assisted steering assembly of claim 18 wherein said tensioning device further comprises a pneumatic cylinder.

21. The assisted steering assembly of claim 18 wherein said tensioning device further comprises a hydraulic cylinder.

22. The assisted steering assembly of claim 18 wherein said tensioning device further comprises a spring.

* * * * *